US005820438A

United States Patent [19]

Horton, III

[11] Patent Number: 5,820,438

[45] Date of Patent: Oct. 13, 1998

[54] TOY BAT

[76] Inventor: Larkin Horton, III, 445 Arlington Cir., Lenoir, N.C. 28645

[21] Appl. No.: 772,506

[22] Filed: Dec. 24, 1996

[51] Int. Cl.[6] ..... A63H 5/00; A63H 33/18; A63B 59/06

[52] U.S. Cl. ..... 446/213; 446/216; 446/404; 446/473; 473/564

[58] Field of Search ..... 473/457, 564, 473/566, 567, 568; 446/169, 170, 105, 473, 397, 404, 213–216

[56] References Cited

U.S. PATENT DOCUMENTS

| | | | |
|---|---|---|---|
| D. 370,276 | 5/1996 | Davis | D26/37 |
| 2,968,890 | 1/1961 | Nisco | 446/216 |
| 4,079,936 | 3/1978 | Schachter | 273/67 |
| 4,116,108 | 9/1978 | Hyman | 446/213 |
| 4,283,057 | 8/1981 | Ragan | 446/216 |
| 4,678,450 | 7/1987 | Scolari et al. | 446/405 |
| 4,819,935 | 4/1989 | Dirksing et al. | 473/457 X |
| 4,881,736 | 11/1989 | Fox | 273/26 B |
| 4,907,800 | 3/1990 | Passamaneck et al. | 473/457 |
| 5,219,163 | 6/1993 | Watson | 273/67 |
| 5,279,513 | 1/1994 | Connelly | 446/219 |
| 5,306,193 | 4/1994 | Yang | 446/215 |
| 5,324,227 | 6/1994 | Yuh-Ching | 446/473 |
| 5,360,209 | 11/1994 | Mollica | 473/457 |
| 5,451,047 | 9/1995 | Lin | 473/457 |
| 5,590,875 | 1/1997 | Young | 473/457 |

*Primary Examiner*—Robert A. Hafer
*Assistant Examiner*—Laura Fossum

[57] ABSTRACT

A toy bat (10) having a handle (12) which has a handle base (12A) securely fastened to a handle stopper (12B). The handle base (12A) and the handle stopper (12B) have a handle female fastener (12C) therein and therethrough, respectively. The toy bat further has a bat (14) which is removably attachable to the handle (12). The bat (14) comprises a bat male fastener (14A) which securely engages the handle female fastener (12C). The bat (14) further comprises a bat shaft (14B) extending longitudinally from and parallel with the bat male fastener (14A). A whistle (16) is optionally integrally mounted within the distal end of the bat shaft (14B).

2 Claims, 3 Drawing Sheets

FIG. 2

TOY BAT

BACKGROUND OF THE INVENTION

1. Field of the Invention

The present invention relates to a toy bat. More particularly, the present invention relates to a toy bat having a handle removably attachable to a bat with a whistle integrally mounted at a distal end.

2. Description of the Prior Art

Toy bats are well known in the art. They have various configurations as well as composition. The most well known are hollow plastic bats having a handle integrally molded therein. Another group of bats are constructed from soft pliable foam with a handle integrally molded therein. However, there exists a need for a toy bat with a flexible bat shaft removably fastenable onto a handle.

Numerous innovations for a toy bat have been provided in the prior art that are described as follows. Even though these innovations may be suitable for the specific individual purposes to which they address, they differ from the present invention as hereinafter contrasted.

In U.S. Pat. No. D370,276, titled Lighted Baton, invented by Ronald O. Davis, the ornamental design for a lighted baton, is as shown and described.

In U.S. Pat. No. 5,279,513, titled Illuminating Toy, invented by Keith Connelly, an illuminated toy sword includes a handle. A light source mounted in said handle provides focused light. A light rod has a first end and a second end, the first end being optically coupled to the light source. The light source is focused upon the second end of the light rod, such that the light rod is substantially evenly illuminated.

In U.S. Pat. No. 5,219,163, titled Foam Bat, invented by H. Kirk Watson, a rubber or plastic foam bat for recreational and/or therapeutic use. The bat includes a solid, generally cylindrical handle and a long, flexible tubular impact barrel longitudinally connected to the handle. The impact portion has a blind coaxial bore which closes momentarily when a blind coaxial bore which closes momentarily when the bat strikes an object and subsequently reopens, thereby generating a loud noise. The bat preferably is formed from a thermoplastic or thermosetting material such as polyethylene.

In U.S. Pat. No. 4,678,450, titled Toy Light Sword, invented by John E. Scolari, Robert T. Warner and Joe E. Deavenport, a toy light sword including a hollow blade with a fluorescent coating on the inside, or it may be translucent and tend to glow when illuminated. A stroboscopic lamp unit is discharged by a switch to provide a burst of high intensity light and a glow on the sword blade. An inertial switch is provided in the blade in one optional embodiment whereby the high-intensity light is discharged when the sword is moved against an object to indicate that contact has been made. Also, a sound generator can be provided to emit a sound when the burst of light occurs. An exemplary circuit for use with the light sword is also part of the invention.

In U.S. Pat. No. 4,079,936, titled Foam Bat, invented by Robert S. Schachter, a resilient, flexible foam plastic or rubber bat is used as an amusement device or child's psychological play aid or the like. The bat is entirely free of internal rigidifying members. A band of material tightly wrapped about the bat adjacent an end to form a narrowed region in which the foam material is compressed to provide a handle sufficient with rigidity and tear strength and without requiring the use of internal rigid members.

The above patented inventions differ from the present invention because they lack one or more of the following features: removable handle having a handle stopper, and a tapered bat shaft having a whistle integrally mounted on a distal end.

Numerous innovations for toy bats have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a toy bat. More particularly, the present invention relates to a toy bat having a handle removably attachable to a bat with a whistle integrally mounted at a distal end.

The types of problems encountered in the prior art are most bats are constructed from a hard plastic or lack rigidity of a handle.

In the prior art, unsucessfal attempts to solve this problem were attempted namely: soft pliable bats. However, the problem was solved by the present invention because it integrates a hard plastic handle with a soft pliable bat shaft.

Innovations within the prior art are rapidly being exploited in the field of toys.

The present invention went contrary to the teaching of the art which describes and claims hard hollow bats and soft pliable bats.

The present invention solved a long felt need for a soft pliable bat having a whistle integrally mounted therein and a hard handle.

The present invention produced unexpected results namely: the whistle attracted more persons to view the advertising indicia on the bat shaft.

Accordingly, it is an object of the present invention to provide a toy bat having a handle removably mountable onto a bat.

More particularly, it is an object of the present invention to provide the handle having a bat male fastener with a plurality of bat male fastener threads thereon.

In keeping with these objects, and with others which will become apparent hereinafter, one feature of the present invention resides, briefly stated, in the handle having a bat shaft having bat shaft indicia thereon.

When the bat shaft is designed in accordance with the present invention, a whistle is integrally mounted at a distal end therein.

In accordance with another feature of the present invention, the handle has a handle base attached to a handle stopper having a handle female fastener therein and therethrough.

Another feature of the present invention is that a handle female fastener has a plurality of handle female fastener threads therein which are complimentary to the bat male fastener threads.

Yet another feature of the present invention is that the handle has handle base indicia thereon.

The novel features which are considered characteristic for the invention are set forth in the appended claims. The invention itself however, both as to its construction and its method of operation, together with additional objects and advantages thereof will be best understood from the following description of the specific embodiments when read and understood in connection with the accompanying drawings.

BRIEF LIST OF REFERENCE NUMERALS UTILIZED IN THE DRAWING

10—toy bat (10)
12—handle (12)
12A—handle base (12A)
12AA—handle base indicia (12AA)
12B—handle stopper (12B)
12C—handle female fastener (12C)
12CA—handle female fastener threads (12CA)
14—bat (14)
14A—bat male fastener (14A)
14AA—bat male fastener threads (14AA)
14B—bat shaft (14B)
14BA—bat shaft indicia (14BA)
16—whistle (16)

DESCRIPTION OF THE PREFERRED EMBODIMENT

Figure 1:
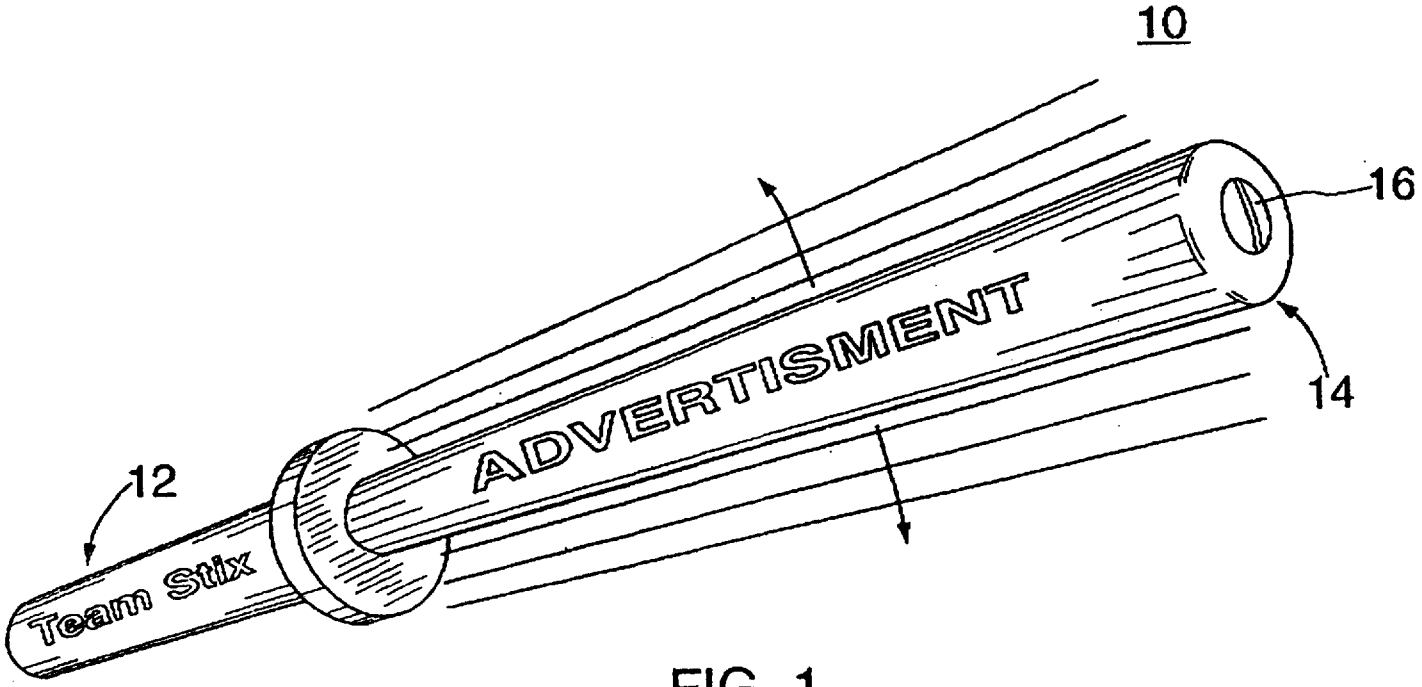
FIG. 1 is a perspective view of a toy bat.
Figure 2:
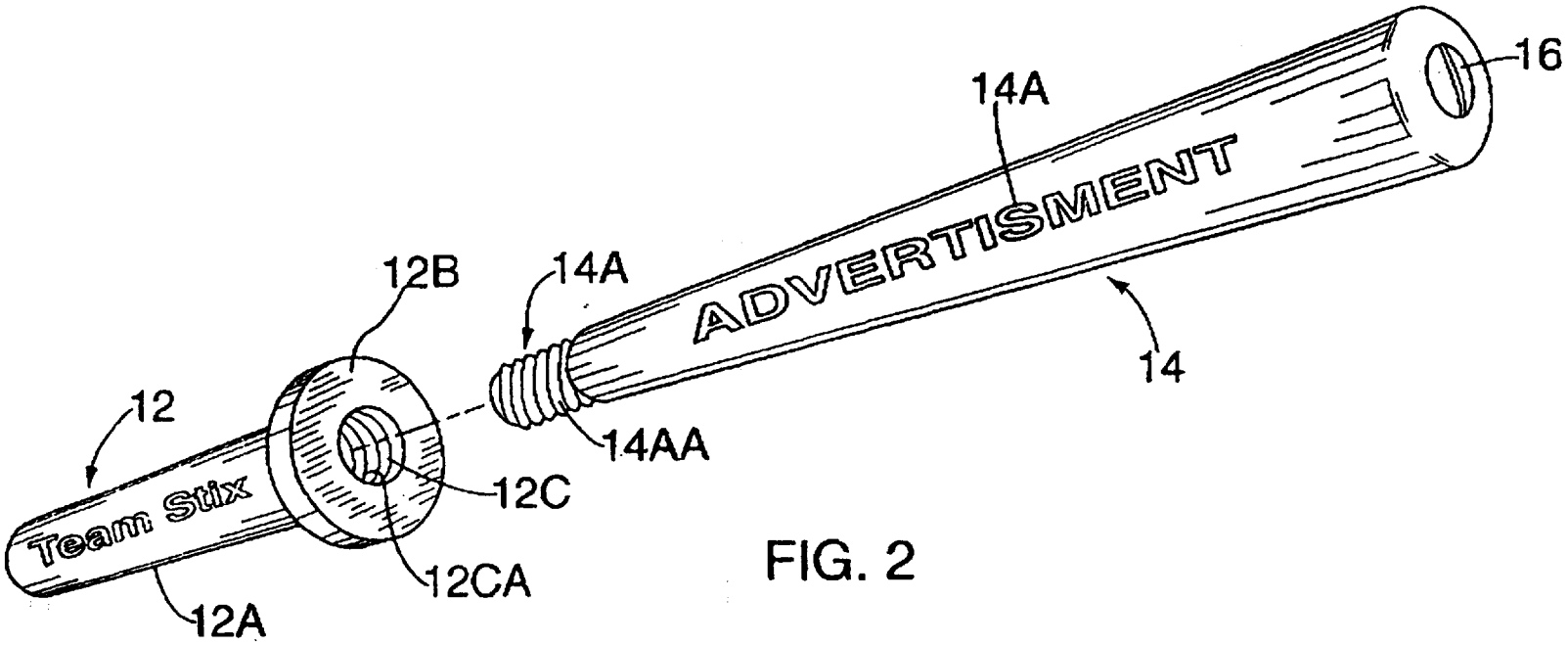
FIG. 2 is a perspective view of a toy bat exhibiting a handle being fastened onto a bat.

Firstly, referring to FIG. 1 and FIG. 2 which are a perspective view of a toy bat (10) and a toy bat (10) exhibiting a handle (12) being fastened onto a bat (14), respectively. The toy bat (10) comprises a handle (12) having a handle base (12A) securely fastened to a handle stopper (12B). The handle base (12A) and the handle stopper (12B) have a handle female fastener (12C) therein and therethrough, respectively. The handle base (12A) may optionally comprise handle base indicia (12AA) thereon. If present, the handle base indicia (12AA) is selected from a group consisting of team names, colleges, cities, and advertisements. The handle base indicia (12AA) is a color selected from a group consisting of primary, pastel, florescent and day-glo. When incorporated thereon, the handle base indicia (12AA) is preferably day-glo. The handle (12) is manufactured from a material selected from a group of materials consisting of plastic, plastic composite, metal, metal alloy, wood, ceramic, fiberglass, epoxy, carbon-graphite, rubber and rubber composite. The handle (12) is preferably manufactured from light weight plastic.

The toy bat (10) comprises a bat (14) which is removably attachable to the handle (12). The bat (14) comprises a bat male fastener (14A) which securely engages the handle female fastener (12C). The bat (14) further comprises a bat shaft (14B) extending longitudinally from and parallel with the bat male fastener (14A). The bat shaft (14B) may optionally comprise bat shaft indicia (14BA) thereon. If present, the bat shaft indicia (14BA) is selected from a group consisting of team names, colleges, cities, and advertisements. The bat shaft indicia (14BA) is a color selected from a group consisting of primary, pastel florescent and day-glo. When printed thereon, the bat shaft indicia (14BA) is preferably day-glo. The bat (14) is manufactured from a material selected from a group of materials consisting of plastic, plastic composite, metal, metal alloy, wood, ceramic, fiberglass, epoxy, carbon-graphite, rubber and rubber composite. The bat (14) is preferably manufactured from light weight closed cell foam. The bat (14) is preferably flexible. The bat shaft (14B) is preferably tapered in an expanding configuration with a narrower part adjacent to the bat male fastener (14A) to simulate a real major league baseball bat. The bat shaft (14B) may optionally further comprise a whistle (16) integrally mounted therein. When present, the whistle (16) is integrally mounted at the distal end therein.

Figure 3:
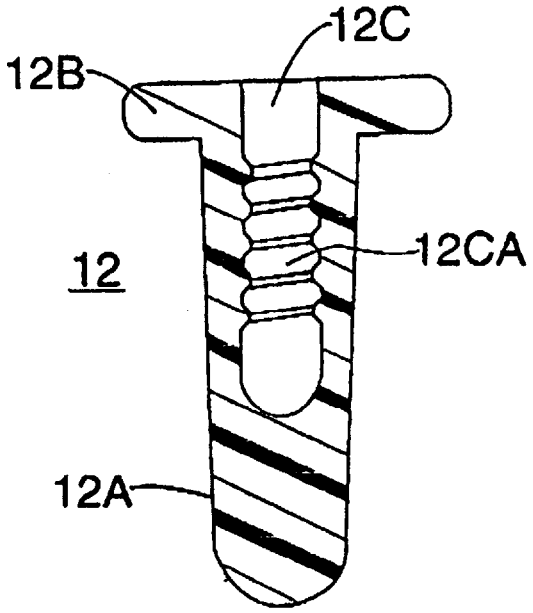
FIG. 3 is a cross sectional view of a handle.

Lastly, referring to FIG. 3 which is a cross sectional view of a handle (12) the handle female fastener (12C) has a plurality of handle female fastener threads (12CA) which are complimentary in configuration to a plurality of bat male fastener threads (14AA) on the bat male fastener (14A).

It will be understood that each of the elements described above, or two or more together, may also find a useful application in other types of constructions differing from the type described above.

While the invention has been illustrated and described as embodied in a toy bat, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A simulated baseball bat for displaying advertisements, promotional indicia, or the like, said simulated bat comprising a generally rigid handle configured and sized to be gripped by a user, an axial, threaded bore extending partially into said handle, and an annular flanged member extending radially from the opening of said threaded bore, a pliant and tapered, elongated bat shaft having complementary, axially extending threads on a first end thereof for removably engaging the threaded bore of said handle, and an axial recess at the opposite end of said pliant and tapered, elongated bat shaft, and a whistle integrally mounted within said recess, whereby a rapid flexing of said pliant bat shaft will result in a noise emanating from said whistle.

2. The simulated baseball bat according to claim 1, wherein said bat shaft is tapered outwardly from said annular flanged member to said opposite end thereof.

* * * * *